US011372352B2

(12) United States Patent
Hori

(10) Patent No.: US 11,372,352 B2
(45) Date of Patent: Jun. 28, 2022

(54) PREVENTING POLARIZATION OF A TRANSFER ROLLER USING AN ION CONDUCTIVE MEMBER

(71) Applicant: Hewlett-Packard Development Company, L.P., Spring, TX (US)

(72) Inventor: Satoru Hori, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/414,885

(22) PCT Filed: Jul. 20, 2020

(86) PCT No.: PCT/US2020/042758
§ 371 (c)(1),
(2) Date: Jun. 16, 2021

(87) PCT Pub. No.: WO2021/016178
PCT Pub. Date: Jan. 28, 2021

(65) Prior Publication Data

US 2022/0137537 A1 May 5, 2022

(30) Foreign Application Priority Data

Jul. 24, 2019 (JP) ..... JP2019-135841

(51) Int. Cl.
*G03G 15/16* (2006.01)

(52) U.S. Cl.
CPC ..... *G03G 15/1665* (2013.01)

(58) Field of Classification Search
CPC . G03G 15/1665; G03G 15/1675; G03G 15/80
USPC ..... 399/90, 121, 314
See application file for complete search history.

(56) References Cited

U.S. PATENT DOCUMENTS

| | | | |
|---|---|---|---|
| 6,990,300 | B2 | 1/2006 | Saito et al. |
| 8,718,501 | B2 | 5/2014 | Aoki |

FOREIGN PATENT DOCUMENTS

| | | | |
|---|---|---|---|
| JP | 1995152224 | | 11/1993 |
| JP | 2003131497 | A | 5/2003 |
| JP | 2005221537 | | 2/2004 |
| JP | 2004094157 | A | 3/2004 |
| JP | 2006084731 | | 9/2004 |
| JP | 2009069826 | | 9/2008 |
| JP | 2013061504 | | 9/2011 |
| WO | WO-2021045940 | A1 * | 3/2021 |

* cited by examiner

*Primary Examiner* — William J Royer
(74) *Attorney, Agent, or Firm* — Staas & Halsey LLP

(57) ABSTRACT

A transfer device includes a transfer roller, a power source and a switch device. The transfer roller may transfer an image formed on an image carrier to a transfer medium in an imaging apparatus. The transfer roller includes a rotation shaft including a conductive material, and a ion conductive member disposed around the rotation shaft. The power source may generate a transfer voltage. The switch device may selectively connect, during rotation of the transfer roller, a power-feed path from the power source to the transfer roller, among a plurality of power-feed paths based on whether the image is being transferred or not being transferred, to thereby reverse the direction of an electric field applied by the transfer voltage to the ion conductive member.

15 Claims, 17 Drawing Sheets

PREVENTING POLARIZATION OF A TRANSFER ROLLER USING AN ION CONDUCTIVE MEMBER

BACKGROUND

Some imaging apparatuses include a transfer roller to transfer a toner image formed on a transfer belt or a transfer drum, to a paper sheet. A transfer nip is formed between the transfer roller and the transfer belt or drum. The transfer roller may include an ion conductive member made of epichlorohydrin rubber, which is disposed on a rotation shaft made of a conductive material. When a transfer voltage is applied through the rotation shaft to supply a current through the transfer nip, ions in the ion conductive member become disproportionate relative to the transfer nip and the rotation shaft over an energization period of time. Consequently, the ion conductive member has an increased volume resistivity.

DETAILED DESCRIPTION

Figure 1:
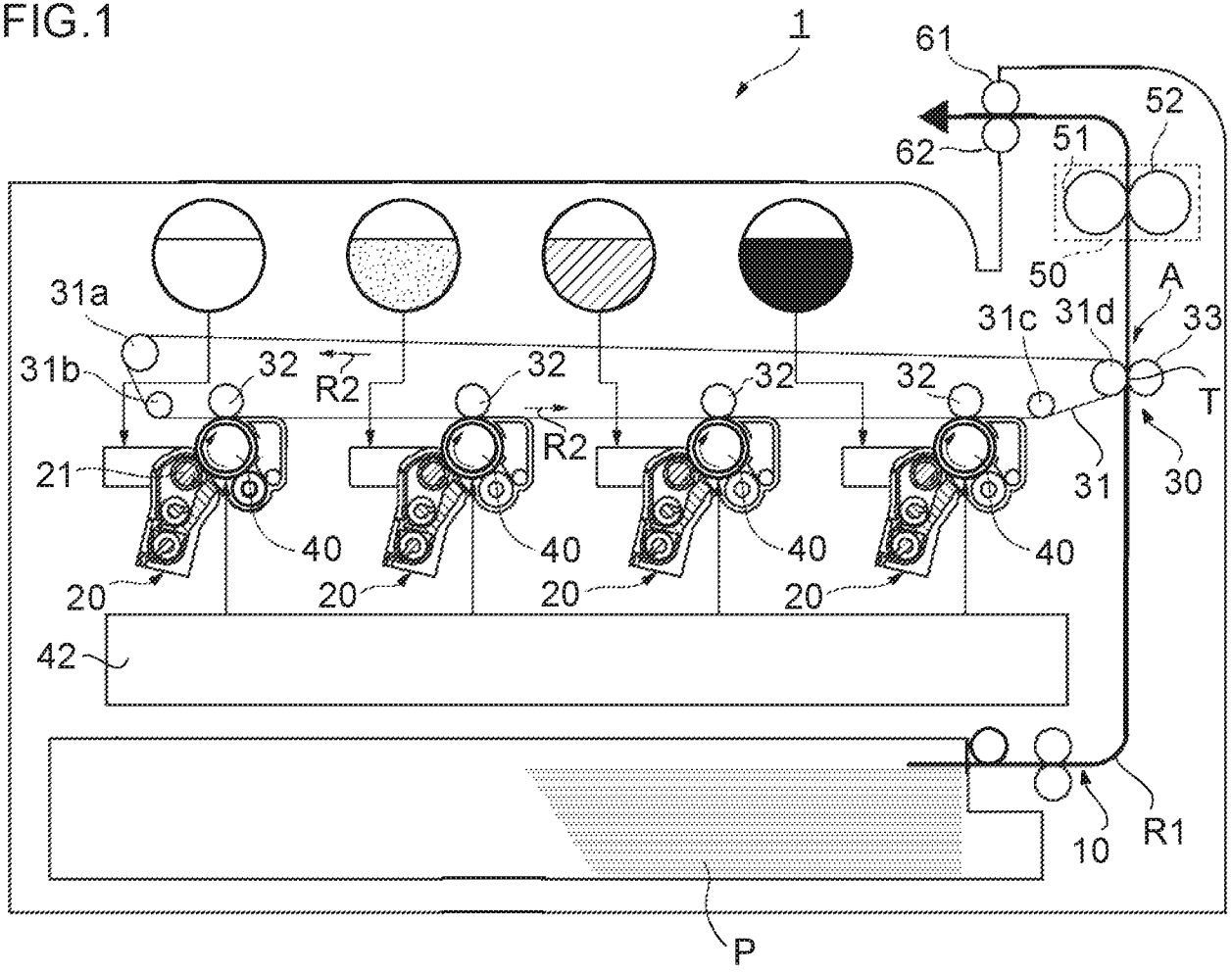
FIG. 1 is a schematic diagram of an example imaging apparatus.

An example transfer device may include a transfer roller to transfer an image formed on an image carrier to a transfer medium in an imaging apparatus, a power source and a power-feed path switching mechanism (or switch device). The transfer roller may include a first rotation shaft of a conductive material and a roller-shaped ion conductive member disposed around the first rotation shaft. The power source may generate a transfer voltage. The power-feed path switching mechanism (or switch device) may switch, during rotation of the transfer roller, a power-feed path (or power supply path) from the power source to the transfer roller between different power-feed paths (power supply paths) depending on whether the image is being transferred or not being transferred, to thereby reverse the direction of an electric field applied by the transfer voltage to the roller-shaped ion conductive member.

In some examples, the transfer roller may be adapted to be capable of contacting with and separating from the image carrier. The power-feed path switching mechanism can perform the switching of the power-feed path: by contacting the transfer roller to the image carrier to select a power-feed path from the power source, the first rotation shaft of the transfer roller, the roller-shaped ion conductive member of the transfer roller, the image carrier and ground when the image is being transferred; and by separating the transfer roller from the image carrier to select a power-feed path from the power source, the roller-shaped ion conductive member of the transfer roller, the first rotation shaft of the transfer roller, and ground when the image is not being transferred.

In some examples, the power-feed path switching mechanism may include an external power feed roller (or external power supply roller), an external power feed roller driving device (or external-power-supply-roller driving device), a transfer roller biasing device, a power feed mechanism (or power supply mechanism), and a grounding mechanism. The external power feed roller (external power supply roller) includes a second rotation shaft of a conductive material and a roller-shaped conductive member disposed around the second rotation shaft. The second rotation shaft and the roller-shaped conductive member are both electrically connected to the power source to apply the transfer voltage. The external power feed roller driving device (external-power-supply-roller driving device) rotates the external power feed roller when the image is not being transferred. The transfer roller biasing device displaces the transfer roller such that the transfer roller is made to contact with the image carrier and separate from the external power feed roller when the image is being transferred, and the transfer roller is made to contact with the external power feed roller and separate fro the image carrier when the image is not being transferred. The power feed mechanism electrically connects the first rotation shaft of the transfer roller and the second rotation shaft of the external power feed roller when the image is being transferred. The grounding mechanism electrically grounds the first rotation shaft of the transfer roller when the image is not being transferred.

In some examples, the roller-shaped conductive member of the external power feed roller is disposed around the second rotation shaft of the external power feed roller in a rotatable manner relative to the second rotation shaft. The transfer roller biasing device may include a transfer roller urging mechanism to normally urge the transfer roller against the external power feed roller, a cam fixed to one end of the second rotation shaft of the external power feed roller, and a cam driving device to rotate the cam. The power feed mechanism may include a first power feed plate of a conductive material disposed in the cam to extend from the second rotation shaft of the external power feed roller to a cam lobe end of the cam, and a second power feed plate of a conductive material disposed adjacent to the cam on the first rotation shaft of the transfer roller. The grounding mechanism may include an electrically grounded ground plate of a conductive material disposed in a position to separate from the first rotation shaft of the transfer roller when the image is being transferred and to contact with the first rotation shaft of the transfer roller when the image is not being transferred. When the image is being transferred, the cam may be rotated by the cam driving device to a first position to push the second power feed plate with the cam lobe end of the cam, such that the transfer roller is separated (or distanced to be spaced apart) from the external power feed roller to contact with the image carrier and the first power feed plate positioned at the cam lobe end of the cam is electrically connected to the second power feed plate. When the image is not being transferred, the cam may be rotated by the cam driving device to a second position where the cam does not have a cam action on the second power feed plate, such that the transfer roller urged by the transfer roller urging mechanism is separated (or distanced to be spaced apart) from the image carrier and made to contact with the external power feed roller.

In some examples, a flange of a conductive material may be disposed on the second rotation shaft of the external power feed roller at one end of the roller-shaped conductive member of the external power feed roller in a rotatable manner relative to the second rotation shaft. The second rotation shaft and the roller-shaped conductive member may be electrically connected with each other via the flange.

In some examples, the external power feed roller driving device can include a first motor, and a first power transmission mechanism to transmit the rotation of the first motor to the external power feed roller.

In some examples, the cam driving device can include a second motor and a second power transmission mechanism to transmit the rotation of the second motor to the cam.

In some examples, the second power feed plate of the power feed mechanism can include a leaf spring adapted to abut against the cam lobe end of the cam when the image is being transferred.

In some examples, the roller-shaped conductive member of the external power feed roller can include a metal roller.

In some examples, the transfer roller biasing device can separate the transfer roller from the external power feed roller after a predetermined period of time from the transfer roller making contact with the external power feed roller.

In some examples, the transfer roller biasing device can separate the transfer roller from the external power feed roller upon power shutoff of the imaging apparatus installed with the transfer device.

In some examples, the transfer roller biasing device can displace the transfer roller to a position of no contact with the image carrier or the external power feed roller.

In some examples, an example imaging apparatus may include the example transfer device.

In some examples, the imaging apparatus can be a monochrome printer or a color printer.

In some examples, an example method may be provided for producing a transfer device having a transfer roller to transfer an image formed on an image carrier to a transfer medium in an imaging apparatus. A transfer roller including a first rotation shaft of a conductive material and a roller-shaped ion conductive member disposed around the first rotation shaft, is disposed. A power source to generate a transfer voltage is further disposed. A power-feed path switching mechanism (or switch device) is disposed, to switch, during rotation of the transfer roller, a power-feed path (or power supply path) from the power source to the transfer roller between different power-feed paths (power supply paths) depending on whether the image is being transferred or not being transferred, to thereby reverse the direction of an electric field applied by the transfer voltage to the roller-shaped ion conductive member.

In the following description, with reference to the drawings, the same reference numbers are assigned to the same components or to similar components having the same function, and overlapping description is omitted. The terms "left" and "right" may refer to respective directions when a drawing is viewed from the front, and they are not always in agreement with directions during actual use of a device. Scale reductions in the drawings are not always based on actual dimensions, and partial emphasis may be made for ease of understanding of the operations and effects of the examples described.

With reference to FIG. 1, an example imaging apparatus 1 forms a color image for example, by using the colors of magenta, yellow, cyan and black. The imaging apparatus 1 has a recording medium conveyance unit (or a recording medium conveyance device) 10 for conveying paper P as a transfer medium, a developing unit (developing device) 20 for developing an electrostatic latent image, a transfer unit (or transfer device) 30 for transferring a toner image onto the paper P, a photosensitive drum 40 as an electrostatic latent image carrier, and a fixing device 50 for fixing the toner image onto the paper P.

The recording medium conveyance unit 10 conveys the paper P on a conveyance path R1. The recording medium conveyance unit 10 allows the paper P to arrive at a secondary transfer region A along the conveyance path R1 at a timing when a toner image to be transferred to the paper P arrives at the secondary transfer region A along a moving path R2.

One developing unit (or developing device) 20 is provided for each of the colors of magenta, yellow, cyan and black, and therefore, four developing units (or devices) are provided. The developing unit (or device) 20 has a developing roller 21 for transferring toner to the photosensitive drum 40. The developing unit 20 mixes and stirs toner and carrier (e.g., carrier particles) to obtain a developer including the toner and carrier particles. The developer is charged, and the developing roller 21 carries the developer having been charged. The developing roller 21 rotates to convey the developer to a region facing to the photosensitive drum 40, where the toner of the developer carried on the developing roller 21 is transferred to an electrostatic latent image formed on an outer circumferential surface of the photosensitive drum 40, to develop the electrostatic latent image.

The transfer device 30 conveys a toner image formed by each of the developing units 20 to the secondary transfer region A where the toner image is to be transferred to the paper P. The transfer device 30 includes an intermediate transfer belt 31 as an image carrier, support rollers 31*a*, 31*b* and 31*c* and a drive roller 31*d* supporting the intermediate transfer belt 31, a primary transfer roller 32 that presses the transfer belt 31 against the photosensitive drum 40, and a transfer roller 33 that presses the intermediate transfer belt 31 against the drive roller 31*d*. The intermediate transfer belt 31 is an endless belt, which is circularly moved by rotation of the support rollers 31*a*, 31*b* and 31*c*, and the drive roller 31*d*. The intermediate transfer belt 31 moves or rotates along the moving path (or conveyance path or route) R2 by rotation of the drive roller 31*d* in the forward direction (for example, a counter-clockwise direction in FIG. 1).

The primary transfer roller 32 presses against the photosensitive drum 40 from an inner circumference of the intermediate transfer belt 31. The transfer roller 33 is a secondary transfer roller that presses against the drive roller 31*d* from an outer circumference of the intermediate transfer belt 31 during a transfer of the toner image formed on the intermediate transfer belt 31. The transfer roller 33 is pressed against the drive roller 31*d* via the intermediate transfer belt 31 and follows in rotation with the drive roller 31*d* and intermediate transfer belt 31. The transfer roller 33 transfers the toner image formed on the intermediate transfer belt 31 to the paper P. A contact point or region between the intermediate transfer belt 31 and the transfer roller 33 is a transfer portion T into which the paper P conveyed along the conveyance path R1. For example, paper sheets P may be conveyed sequentially to the transfer portion T at regular intervals. At this transfer portion T the transfer roller 33 may perform the transferring of the toner image onto the paper P, as the paper P is moved continuously along the transfer portion T.

Four photosensitive drums 40 are provided for the four colors, respectively. The photosensitive drums 40 are arranged at four locations along the moving path R2 of the intermediate transfer belt 31. The developing unit 20 and an exposure unit (exposure device) 42 are arranged at a location substantially facing the photosensitive drum 40.

The fixing device 50 adheres and fixes, to the paper P, the toner image, which has been secondarily transferred from the intermediate transfer belt 31 to the paper P. The fixing device 50 has a heating roller 51 for heating the paper P and a pressing roller 52 for pressing the heating roller 51. A nip portion as a contact region is formed between the heating roller 51 and the pressing roller 52, and the toner image is melted and fixed to the paper P when the paper P is conveyed through the nip portion. The paper P having the toner image fixed by the fixing device 50 passes between discharge rollers 61, 62 and is discharged to the outside of the imaging apparatus 1.

Figure 2:
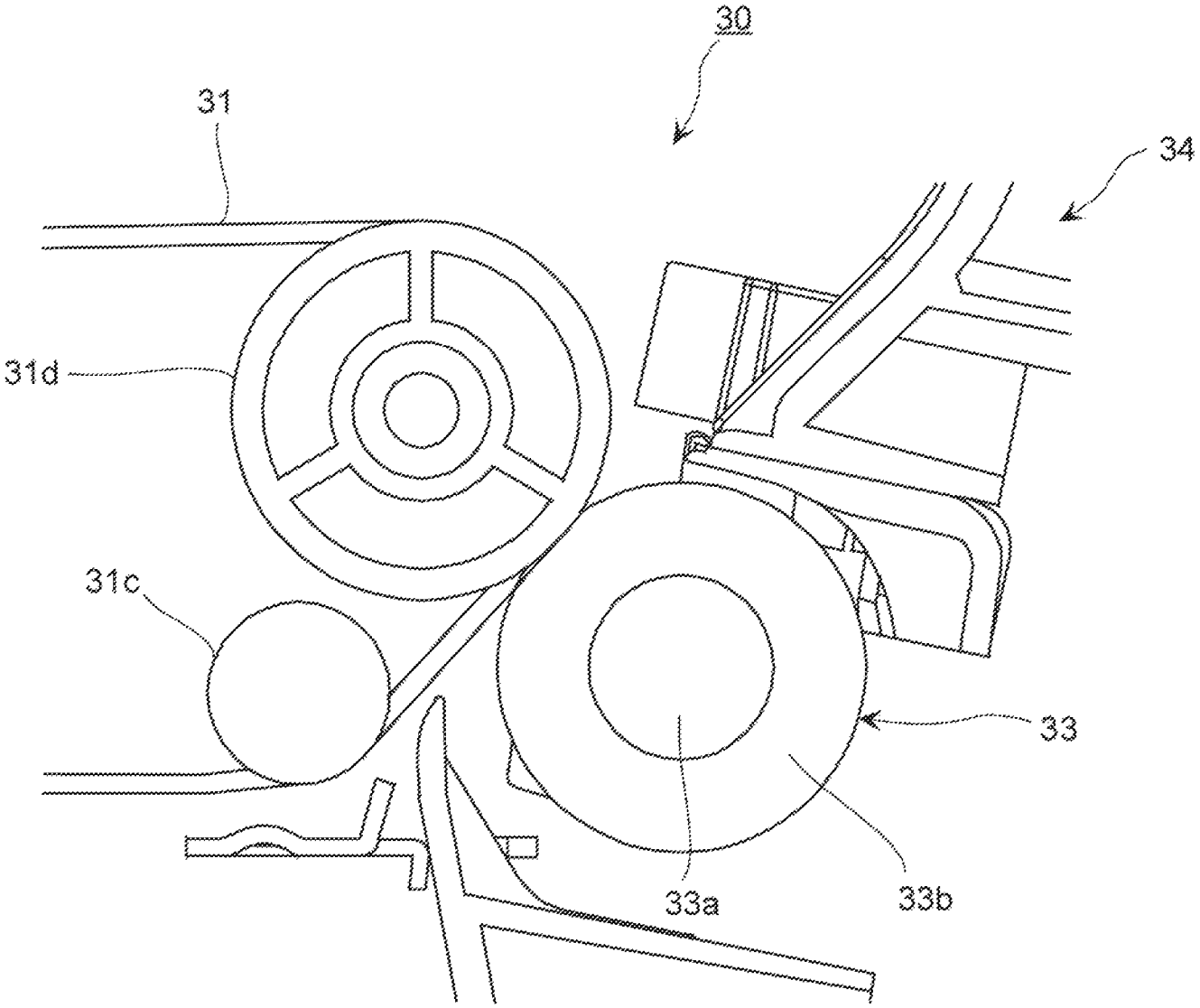
FIG. 2 is a schematic side view illustrating a region in the example imaging apparatus including a transfer roller.

FIG. 2 is an enlarged side view showing the example transfer roller 33 and the vicinity of the transfer roller 33, in the example imaging apparatus 1 illustrated in FIG. 1, which shows a state at a time of transferring the toner image formed on the intermediate transfer belt 31. The example transfer roller 3 has a rotation shaft 33*a* made of a conductive material (e.g., a conductive rotation shaft), and a roller-shaped ion conductive member 33*b*, and the transfer roller 33 is disposed, for example, inside a transfer unit (transfer device) 34.

Figure 3:
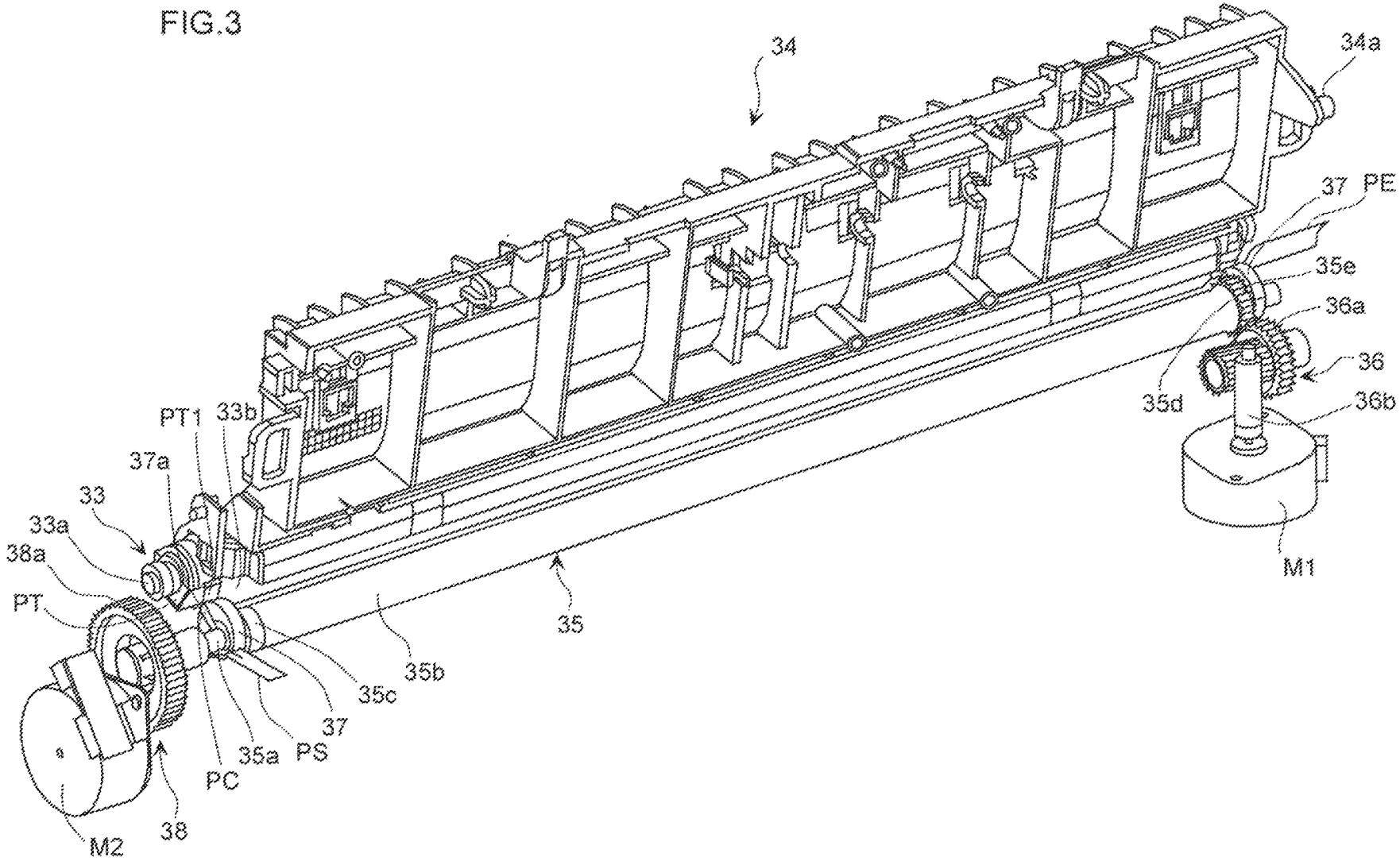
FIG. 3 is a perspective view of an example transfer device.
Figure 4:
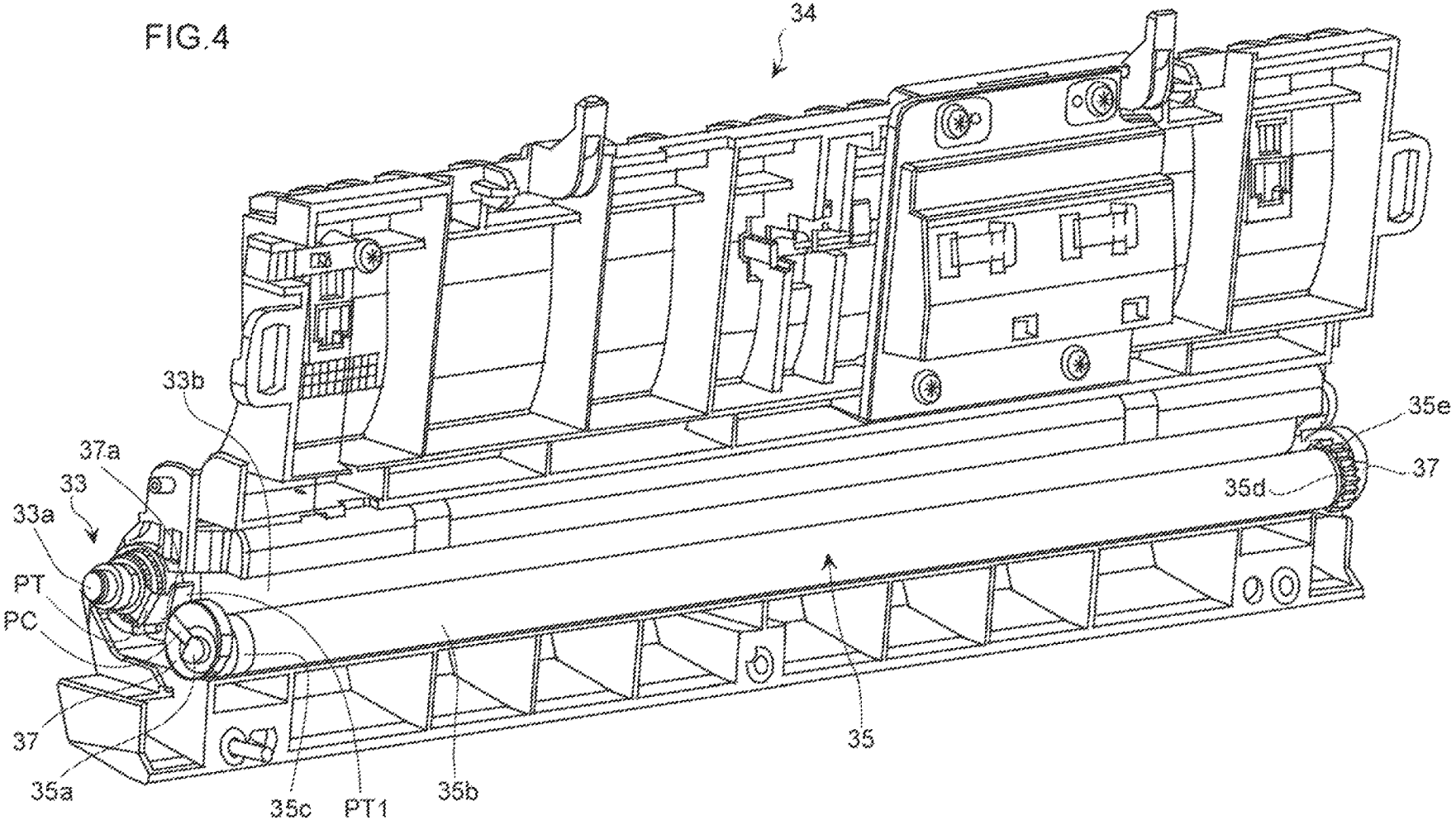
FIG. 4 is a perspective view illustration a portion of the example transfer device.

FIG. 3 is a perspective view showing the transfer unit 34 and the vicinity of the transfer unit 34 in the example transfer device 30. FIG. 4 is another perspective view showing the vicinity of the transfer unit 34 in the example transfer device 30.

The transfer unit 34 is disposed on a chassis of the imaging apparatus 1 so as to be rotatable about, for example, a pair of rotatable shafts 34*a*. Accordingly, the transfer roller 33 disposed in the transfer unit 34 is movable between a first position to press the intermediate transfer belt 31 against the drive roller 31*d*, and a second position that is spaced apart from the intermediate transfer belt 31 and the drive roller 31*d*. For example, the transfer roller 33 may contact or separate from the drive roller 31*d* via the intermediate transfer belt 31 (cf. FIG. 2). A grounding plate PE is disposed near a rotation shaft 33*a* of the transfer roller 33. The grounding plate PE is disposed at such a location as to be capable of contacting and separating from the rotation shaft 33*a* of the transfer roller 33 at the time when the transfer unit 34 is rotated or pivoted about the rotatable shaft 34*a*.

An external power feed roller (or external power supply roller) 35 is disposed adjacent to the transfer roller 33. The transfer unit 34 may include, for example, a transfer roller urging mechanism for urging the transfer roller 33 toward the external power feed roller 35. The transfer roller urging mechanism is disposed, for example, between the transfer unit 34 and the chassis of the imaging apparatus 1, and can be an elastic member such as a spring for rotating the transfer unit 34 in a predetermined direction.

A rotation shaft 35*a* of the external power feed roller 35 is made of a conductive material, and a roller-shaped conductive member 35*b* such as a metal roller is disposed on (or around) the rotation shaft 35*a*. The conductive member 35*b* can be fixed, for example, to two flanges 35*c* and 35*d* between the flanges 35*c* and 35*d* disposed on the rotation shaft 35*a* via a bearing such as an oil-impregnated sintered bearing or a ball bearing. This enables the conductive member 35*b* to rotate relative to the rotation shaft 35*a*. The flange 35*c* is made of a conductive material, for example, enabling electrical connection between the rotation shaft 35*a* and the conductive member 35*b* via the flange 35*c*. The flange 35*c* can be formed of, for example, a conductive resin. The flange 35*d* is formed with a gear 35*e*, and the gear 35*e* is connected to an external power feed roller driving motor (or external power supply driving motor) M1 for rotating the external power feed roller 35 via a power transmission mechanism 36 such as gears 36*a*, 36*b*.

In some examples, cams 37 are fixed to both ends of the rotation shaft 35*a* of the external power feed roller 35, and a cam power feed plate (or cam power supply plate) PC of a conductive material extending from the rotation shaft 35*a* of the external power feed roller 35 to a cam lobe end 37*a* of the cam 37 is disposed at the cam 37.

In some examples, a transfer roller power feed plate (or transfer roller power supply plate) PT including a leaf spring PT1, and being made of a conductive material, is disposed adjacent to the cam 37 on the rotation shaft 35*a* of the external power feed roller 35, at each end of the rotation shaft 33*a* of the transfer roller 33.

In some examples, a cam driving motor M2 for rotating the cam 37 via a power transmission mechanism 38 such as a gear 38*a* is connected to the rotation shaft 35*a* of the external power feed roller 35.

Figure 5:
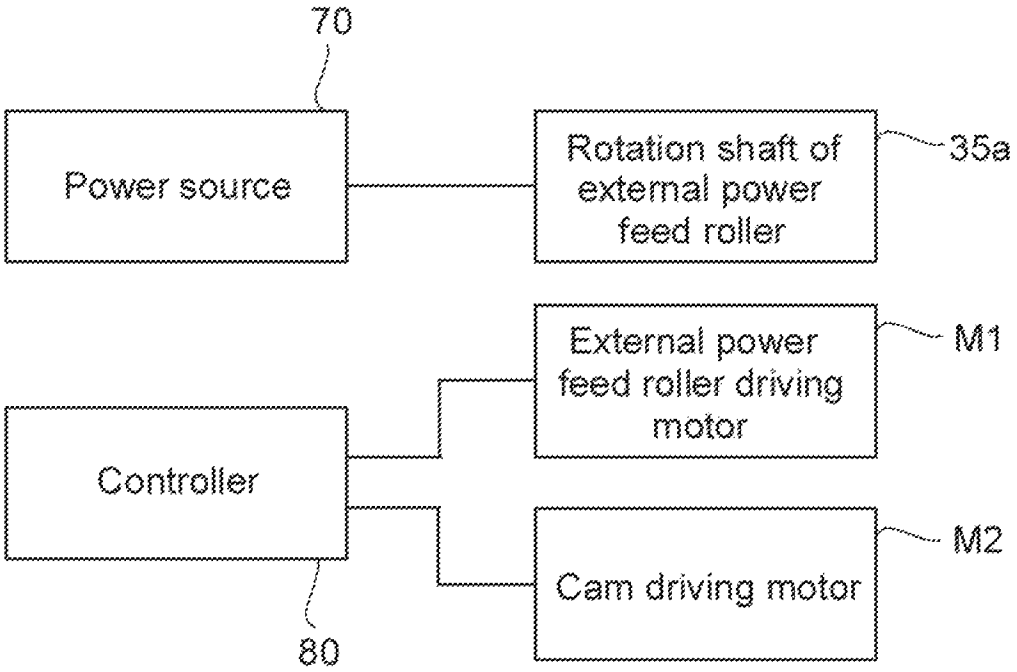
FIG. 5 is a hardware block diagram of the example transfer device.

FIG. 5 is a hardware block diagram of an example transfer device 30. A power source 70 for generating a transfer voltage is electrically connected to, for example, the rotation shaft 35*a* of the external power feed roller 35. The power source 70 can feed (or supply) power of a transfer voltage, for example, by bringing a power feed plate (or power supply plate) PS connected to the power source 70, into contact with the rotation shaft 35*a* as shown in FIG. 3. A controller 80 is connected to the external power feed roller driving motor M1 and the cam driving motor M2, to control the operation of the motors M1 and M2.

FIG. 6A to 6F illustrate operations carried out by the example transfer device during a first operational mode when a toner image is being transferred to a paper sheet P at the transfer portion T (cf. FIG. 1). FIG. 7A to FIG. 7F illustrate operations carried out by the example transfer device during a second operational mode of the imaging apparatus 1, when a toner image is not being transferred (e.g., when no toner image is being transferred) at the transfer portion T (cf. FIG. 1).

Figure 6A:
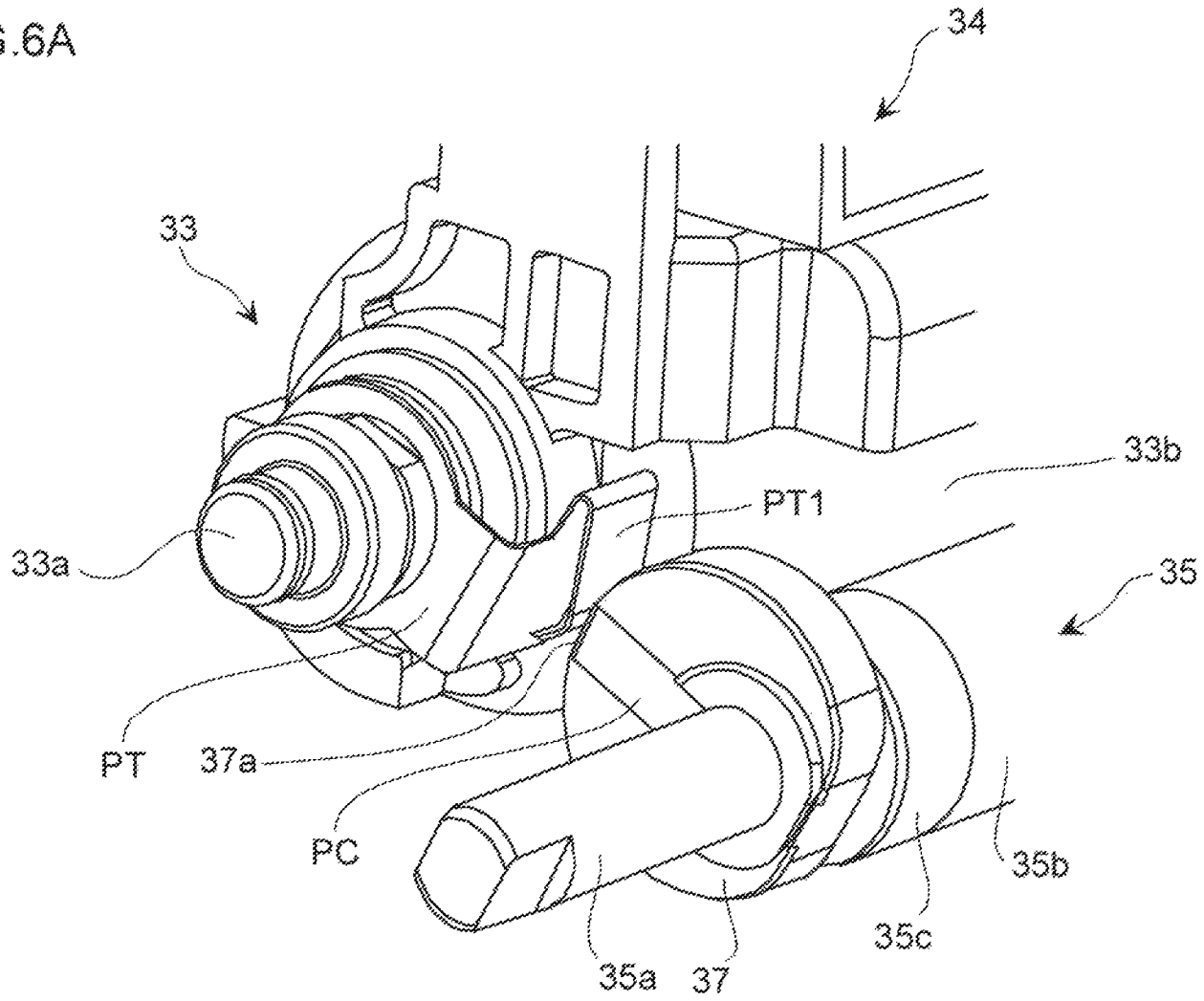
FIG. 6A is a partial perspective view of the example transfer device of FIG. 4 (viewed from the left side), illustrating an operational mode of the transfer device in which an image is being transferred.

FIG. 6A is an enlarged perspective view showing a left-side end of the transfer roller 33 and the external power feed roller 35 shown in FIG. 4. In the first operational mode, when a toner image is being transferred, the rotation shaft 35*a* of the external power feed roller 35 is rotated by the cam driving motor M2 via the power transmission mechanism 38 (cf. FIG. 3), and then stopped at a position as illustrated in FIG. 6A. At this time, the cam lobe end 37*a* of the cam 37 abuts and presses against the leaf spring PT1, which causes the transfer unit 34 to be rotated or pivoted about the rotatable shaft 34*a* (cf. FIG. 3), to separate or distance the transfer roller 33 from the external power feed roller 35, to achieve a state shown in FIG. 6A. The cam power feed plate PC located at the cam lobe end 37*a* of the cam 37 is in contact with the leaf spring PT1, such that the cam power feed plate PC is electrically connected to the leaf spring PT1.

Figure 6B:
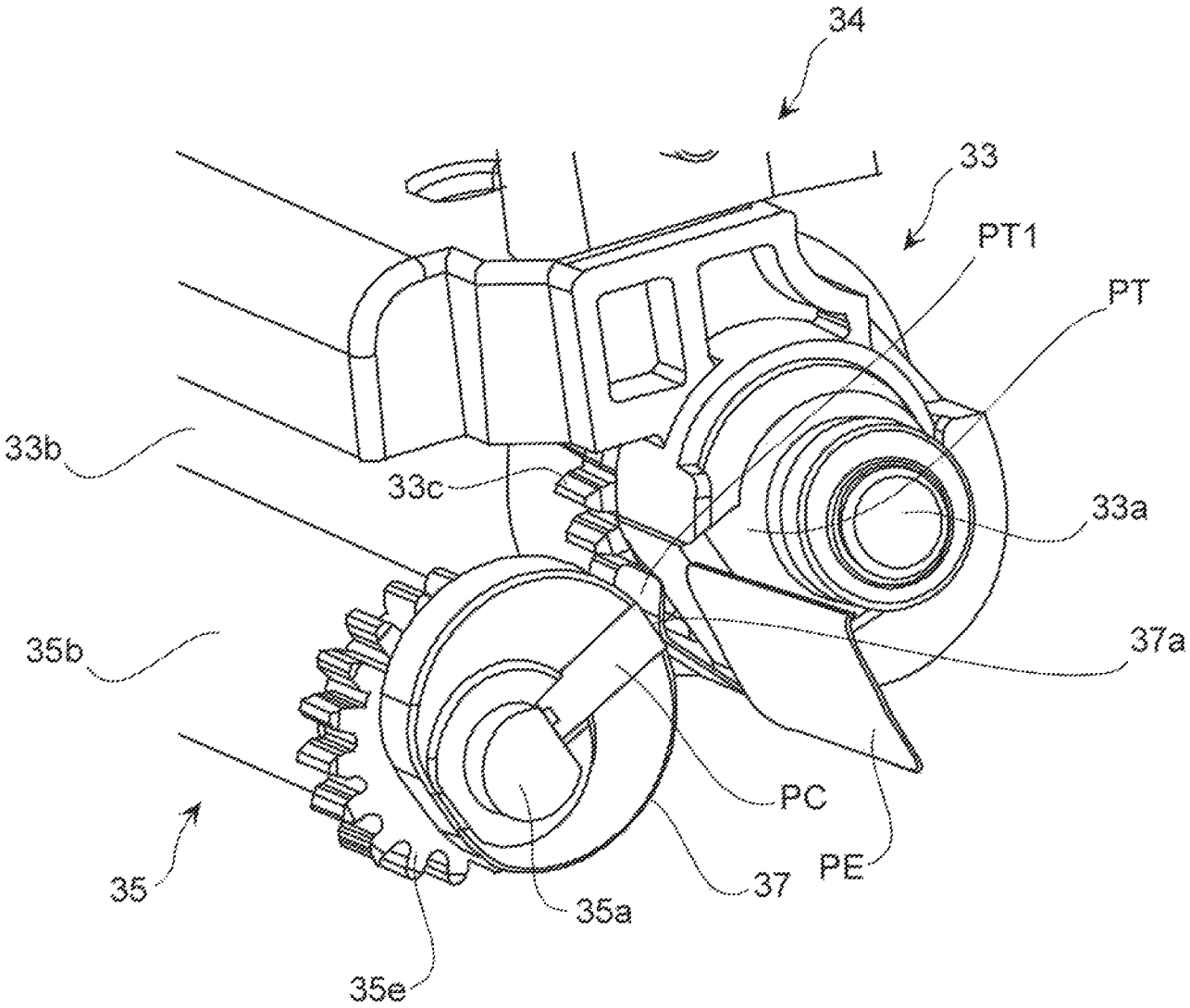
FIG. 6B is a partial perspective view of the example transfer device of FIG. 4 (viewed from the right side), illustrating the operational mode in which an image is being transferred.

FIG. 6B shows a right-side end of the transfer roller 33 and the external power feed roller 35 of the transfer device 34 illustrated in FIG. 4, which are arranged in the same state as in FIG. 6A. As mentioned above with respect to FIG. 6A, in FIG. 6B, the cam 37 rotates the transfer unit 34, thereby separating or distancing the transfer roller 33 from the external power feed roller 35. A gear 33*c* disposed at the right end of the transfer roller 33 is separated or distanced from the gear 35*e* formed on the flange 35*d* of the external power feed roller 35. The rotation shaft 33*a* of the transfer roller 33 is separated or distanced from the grounding plate PE. The cam power feed plate PC located at the cam lobe end 37*a* of the cam 37 is brought into contact with the leaf spring PT1, so that they are electrically connected to each other.

Figure 6C:
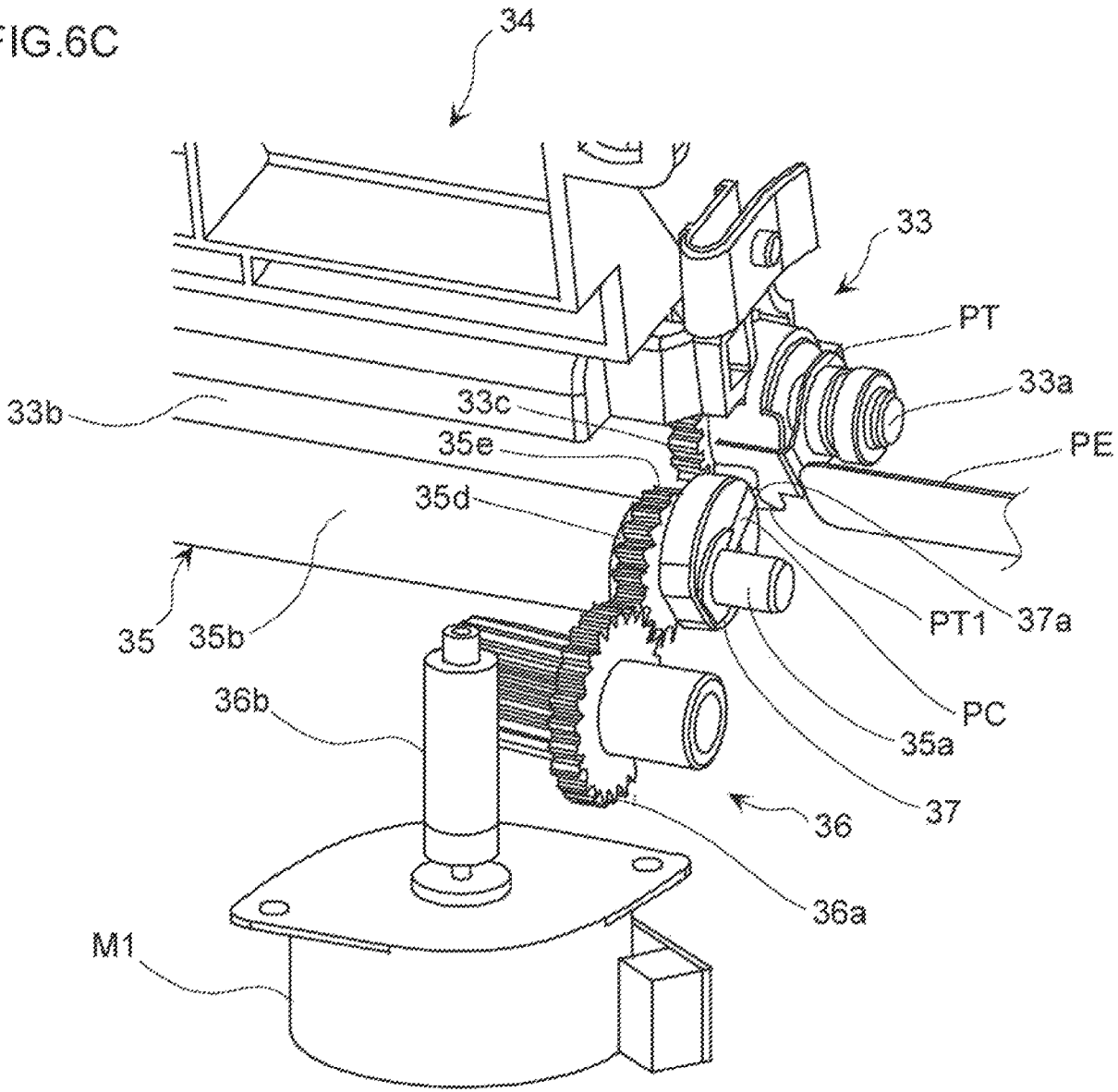
FIG. 6C is a partial perspective view of the example transfer device of FIG. 4 (viewed from the right side), illustrating the operational mode in which an image is being transferred.

FIG. 6C shows a wider region near the right end of the transfer roller 33 and the external power feed roller 35 shown in FIG. 6B, illustrating the relative positions of the external power feed roller 35, and the external power feed roller driving motor M1 and the power transmission mechanism 36. The external power feed roller 35, the power transmission mechanism 36 and the external power feed roller driving motor M1 may be disposed, for example, on the chassis of a printer in a fixed manner, such that gears 35*e*, 36*a* and 36*b* remain in an engaged state with one another. The external power feed roller driving motor M1 is cant oiled by the cant oiler 80, for example, so as to be stopped when a toner image is being transferred.

Figure 6D:
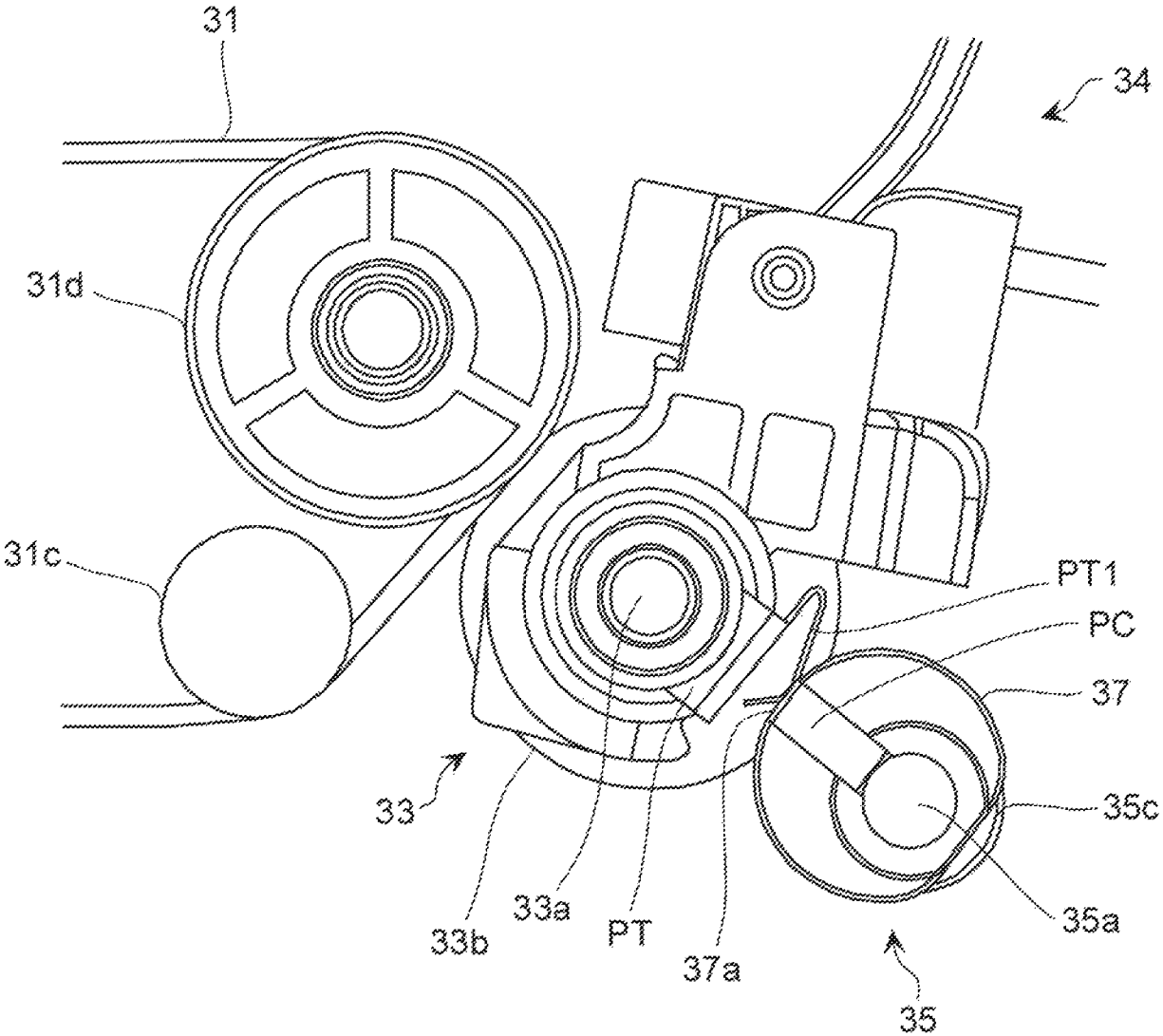
FIG. 6D is a partial left-side view of the example transfer device of FIG. 4, illustrating the operational mode in which an image is being transferred.

FIG. 6D is a side view illustrating the transfer roller 33 and the external power feed roller 35 shown in FIGS. 6A to 6C, as well as the intermediate transfer belt 31 and the drive roller 31*d*. As described above, at the time when a toner image is being transferred, the transfer unit 34 is rotated by a cam action of the cam 37, and the transfer roller 33 is separated or distanced (to be spaced apart) from the external power feed roller 35 and displaced toward the drive roller 31*d* to press against the drive roller 31*d* via the intermediate transfer belt 31 thereby rotating to follow the intermediate transfer belt 31 and the drive roller 31*d*. In this state, the transfer roller 33 contacts the intermediate transfer belt 31 and frictionally engages therewith to rotate. A nip portion is formed between the transfer roller 33 and the intermediate transfer belt 31, enabling transfer of the toner image.

Figure 6E:
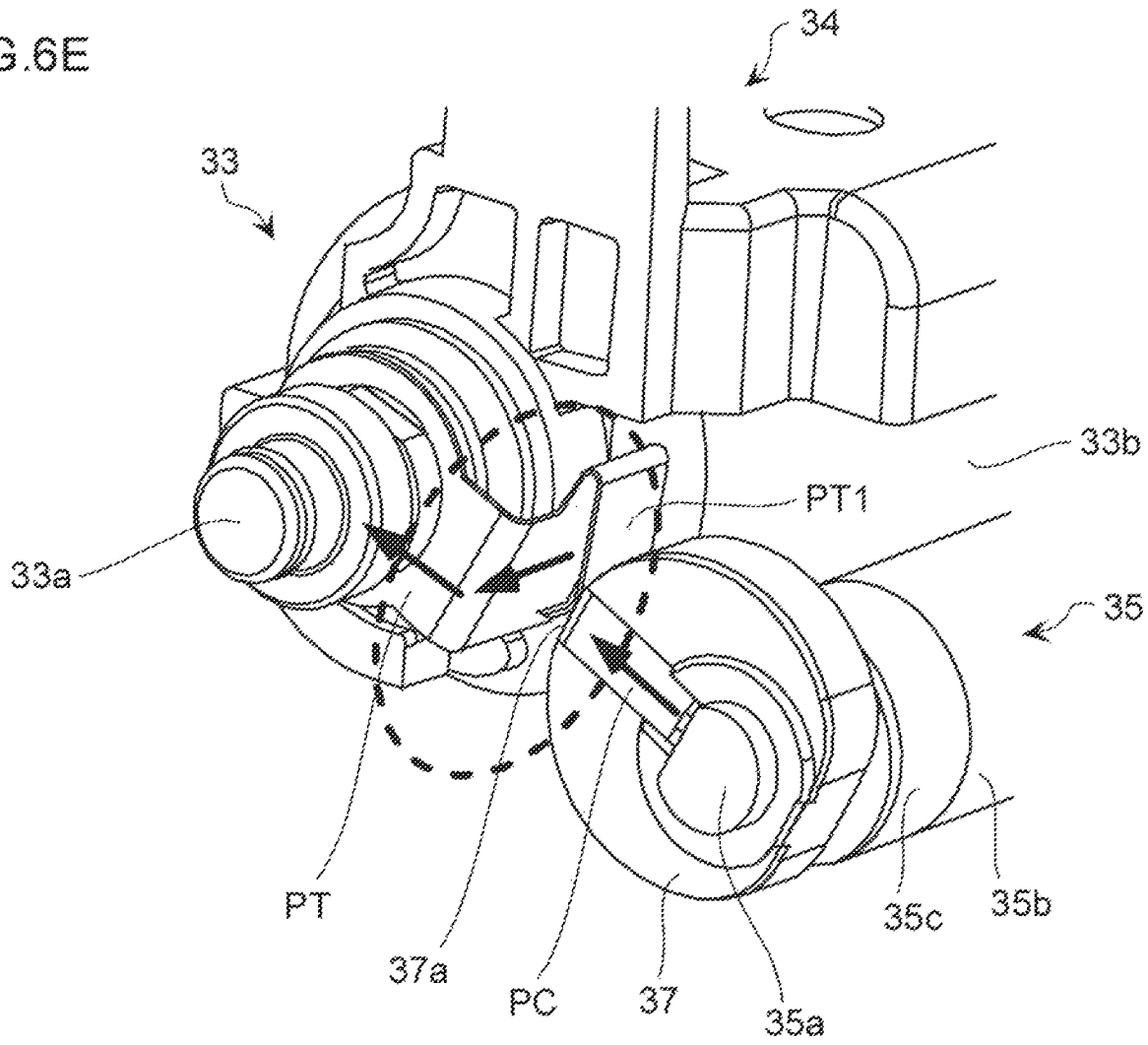
FIG. 6E is a perspective view of the transfer device of FIG. 6A showing a part of a power-feed path in the example transfer device in the operational mode in which an image is being transferred.

With reference to FIG. 6E showing a similar arrangement to FIG. 6A, a power-feed path (or power supply path) from the power source 70 when a toner image is being transferred, is indicated by three arrows. A region circled in a broken line indicates that the transfer roller power feed plate PT is electrically connected to the cam power feed plate PC on the cam 37. The power-feed path from the power source 70 to the transfer roller 33 in this state, is set to supply power via the following sequence of components: Power source 70; Power feed plate PS (cf. FIG. 3); Rotation shaft 35*a*; Cam power feed plate PC; Leaf spring PT1; Transfer roller power feed plate PT; Rotation shaft 33*a*.

Figure 6F:
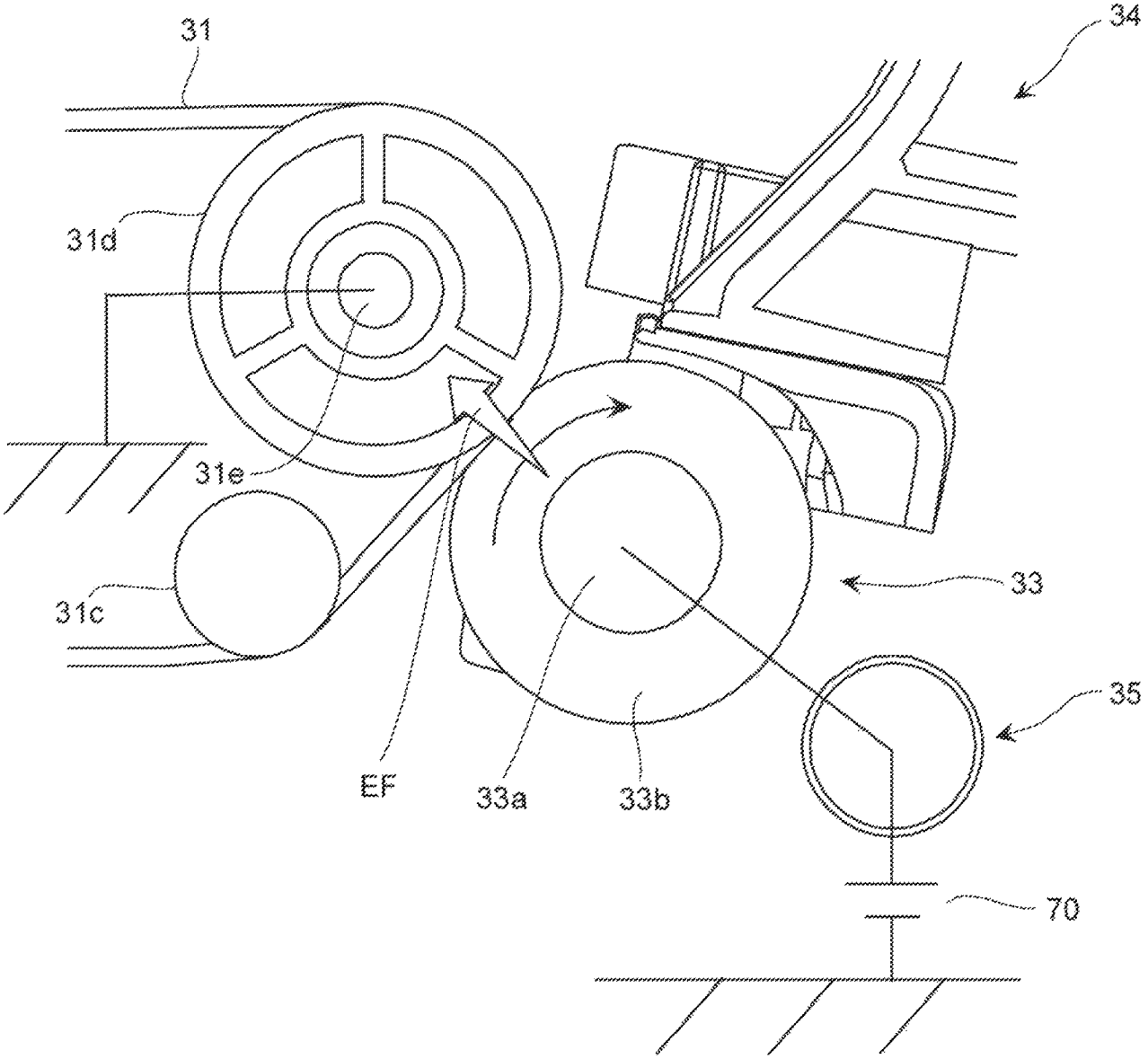
FIG. 6F is an schematic side view of the transfer device of FIG. 6D, showing the power-feed path of the example transfer device in the operational mode in which an image is being transferred.

FIG. 6F is an schematic view illustrating the overall power-feed path. The transfer voltage is supplied from the power source 70 through the rotation shaft 35*a* of the external power feed roller 35 to the rotation shaft 33*a* of the transfer roller 33, then flows through the ion conductive member 33*b*, the intermediate transfer belt 31, and the drive roller 31*d* and a rotation shaft 31*e* electrically connected thereto, and thereafter, to the ground.

Accordingly, an electric field applied to the ion conductive member 33*b* by transfer voltage from the power source 70 when a toner image is being transferred has a direction from the rotation shaft 33*a* of the transfer roller 33 to a radially outward direction thereof. This direction of electric field is shown by an arrow EF.

Next, with reference to FIGS. 7A to 7F, example operations of the example transfer device when a toner image is not being transferred will be described.

Figure 7A:
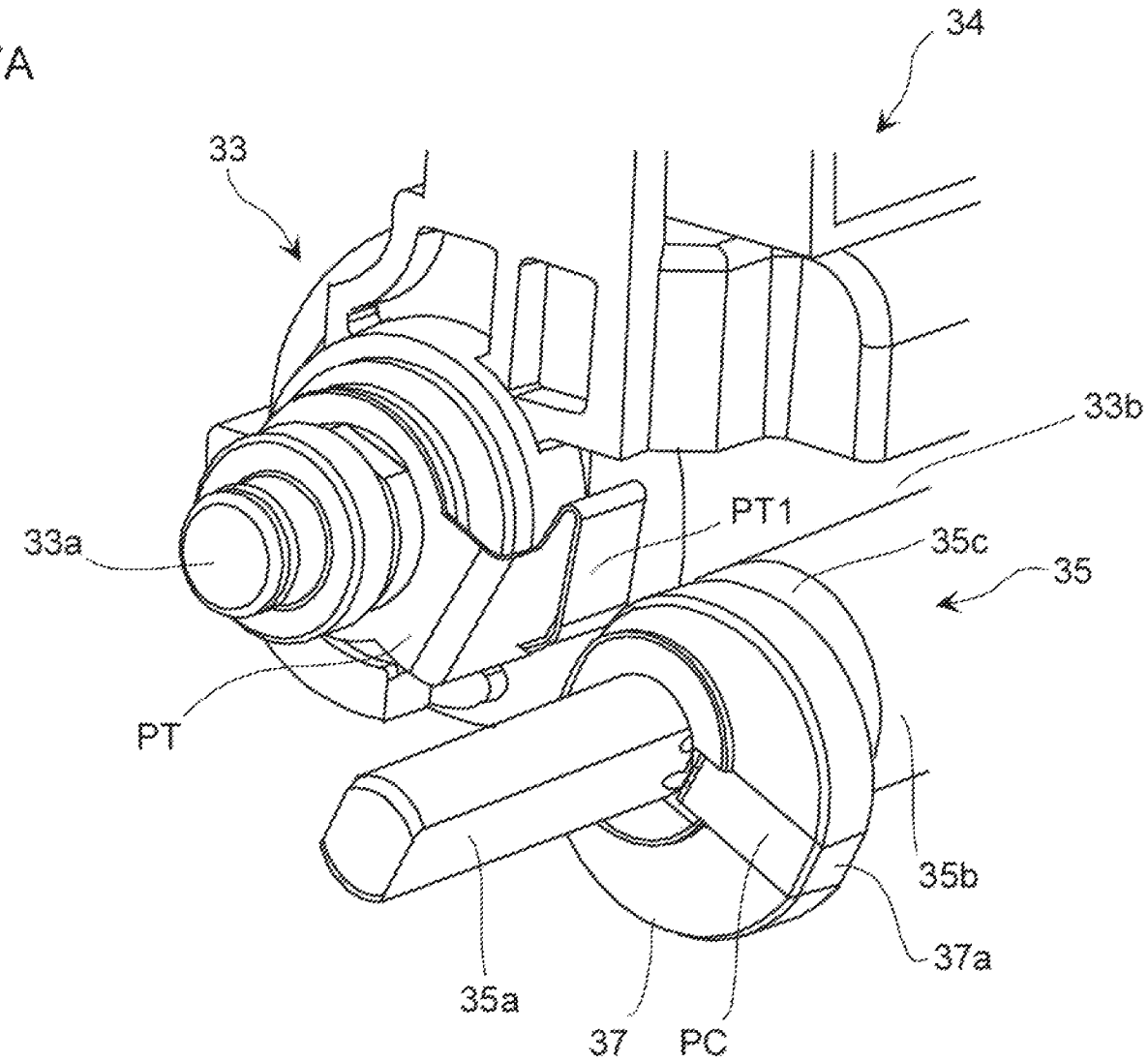
FIG. 7A is a partial perspective view of the example transfer device of FIG. 4 (viewed from the left side), illustrating an operational mode of the transfer device in which no image is being transferred.

FIG. 7A is a perspective view showing the left-side end of the transfer roller 33 and the external power feed roller 35 of the transfer device 34 shown in FIG. 4. When a toner image is not being transferred, the rotation shaft 35*a* of the external power feed roller 35 is rotated by the cam driving motor M2 (cf, FIG. 3) via the power transmission mechanism 38, and the cam 37 is, for example, rotated by 180□ from the position shown in FIG. 6A and stopped at that position. At this time, the cam 37 does not have a cam action (e.g., the cam 37 does not exert any force) on the leaf spring PT1 of the transfer roller power feed plate PT. Accordingly, the transfer unit 34 is urged by the transfer roller urging mechanism to be rotated or pivoted about the rotatable shaft 34*a* (cf. FIG. 3). Consequently, the transfer roller 33 is separated (or distanced to be spaced apart) from the intermediate transfer belt 31 and the drive roller 31*d* and brought into contact with the external power feed roller 35, to achieve a state shown in FIG. 7A. At this time, the leaf spring PT1 comes into such a state as to be electrically disconnected from the cam power feed plate PC on the cam 37.

Figure 7B:
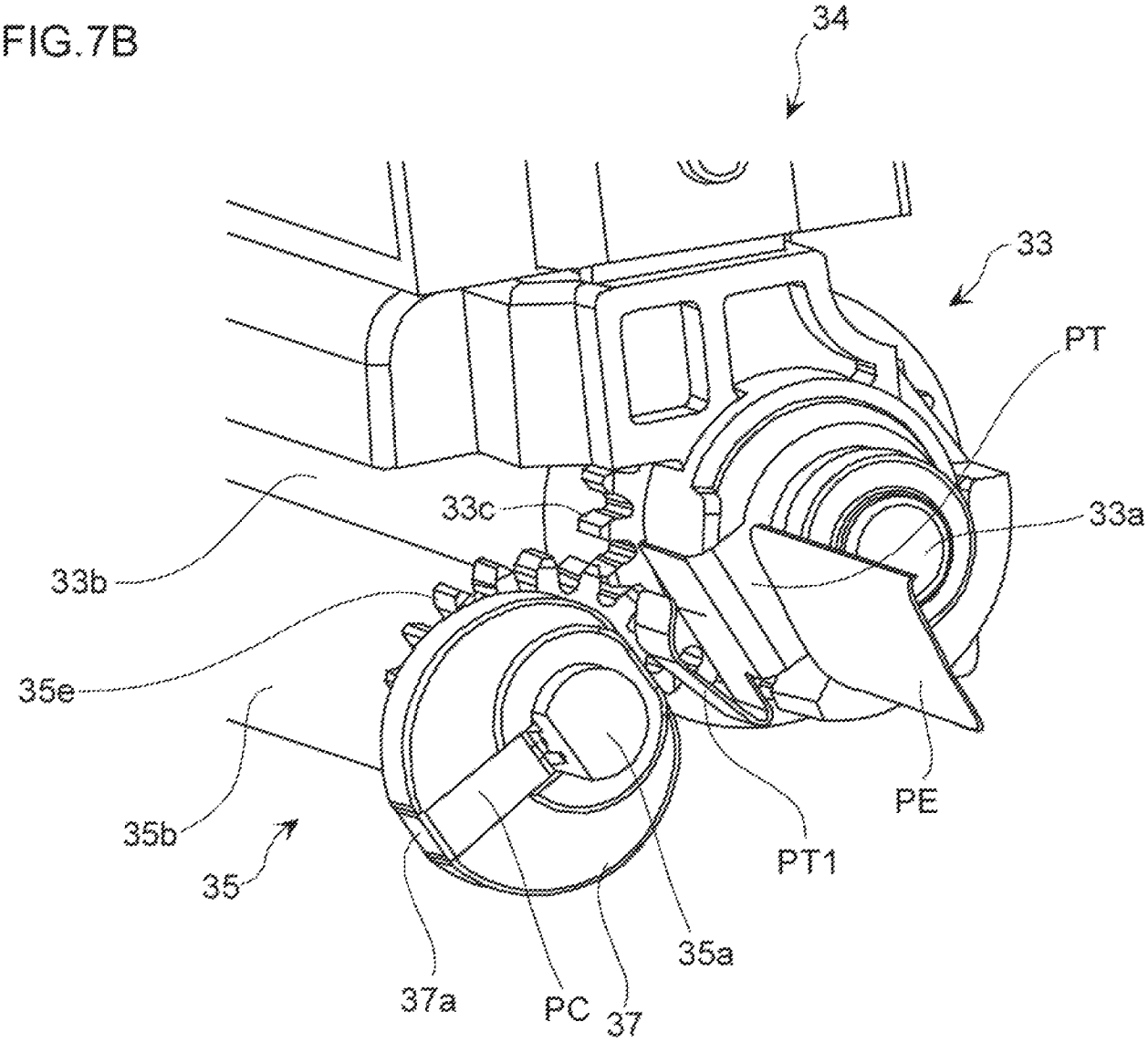
FIG. 7B is a partial perspective view of the example transfer device of FIG. 4 (viewed from the right side), illustrating the operational mode in which no image is being transferred.

FIG. 7B shows a right-side end of the transfer roller 33 and the external power feed roller 35 of the transfer device 34 illustrated in FIG. 4, which are arranged in the same state as in FIG. 7A. As mentioned above with respect to FIG. 7A, in FIG. 7B, the rotation of the transfer unit 34 causes the transfer roller 33 to come into contact with the external power feed roller 35, and at the same time, the gear 33*c* disposed at the right end of the transfer roller 33 is engaged with the gear 35*e* formed in the flange 35*d* of the external power feed roller 35, further bringing the rotation shaft 33*a* of the transfer roller 33 into contact with the grounding plate PE. In this state, the leaf spring PT1 is electrically disconnected from the cam power feed plate PC on the cam 37.

Figure 7C:
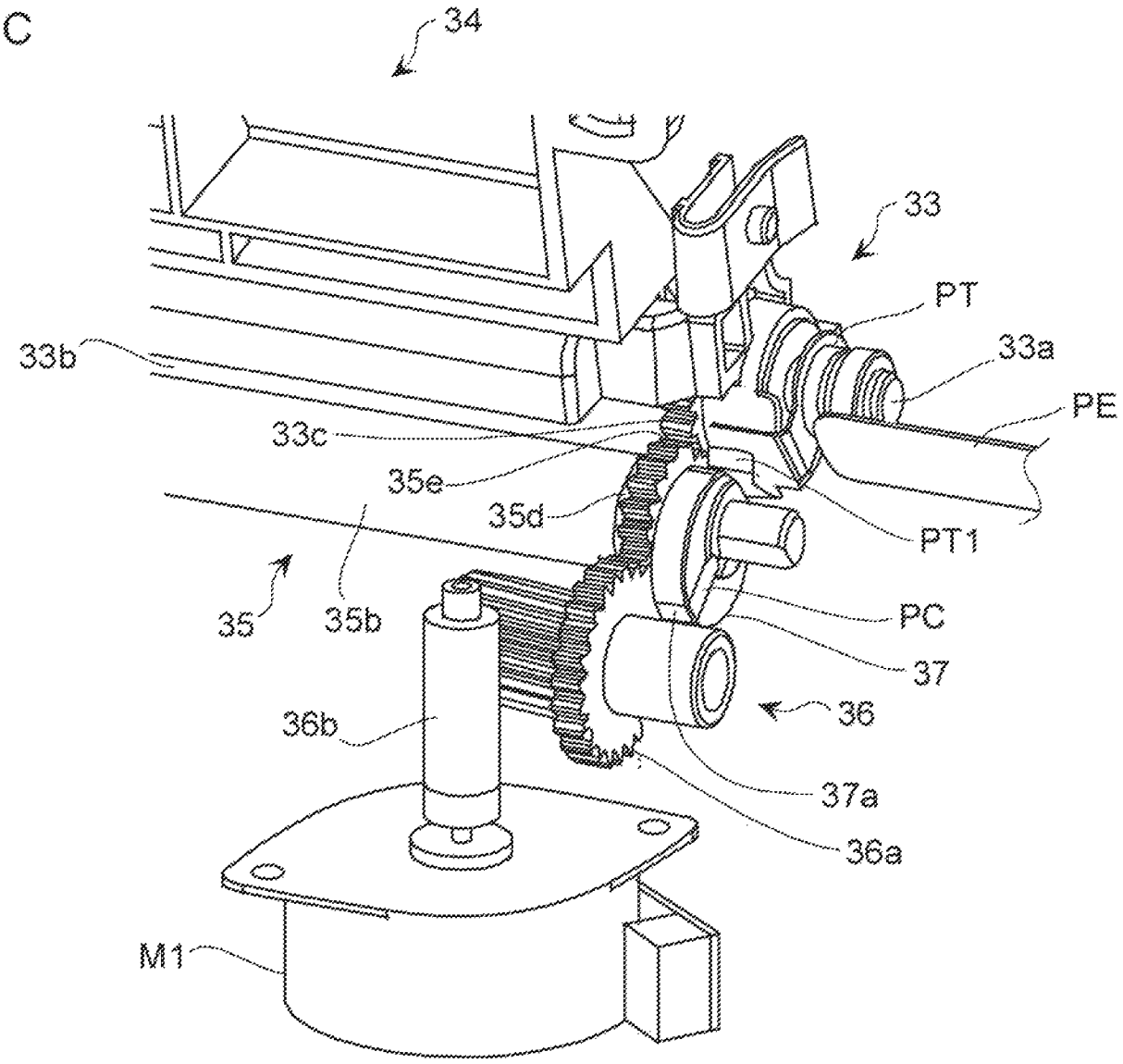
FIG. 7C is a partial perspective view of the example transfer device of FIG. 4 (viewed from the right side), illustrating the operational mode in which no image is being transferred.

FIG. 7C shows a wider region near the right end of the transfer roller 33 and the external power feed roller 35 shown in FIG. 7B. As described above with respect to FIG. 6C, the external power feed roller 35, the power transmission mechanism 36 and the external power feed roller driving motor M1 may be disposed, for example, on the chassis of a printer in a fixed manner, such that the gears 35*e*, 36*a* and 36*b* remain in an engaged state with one another. The external power feed roller driving motor M1 is controlled by the controller 80, for example, so as to rotate when a toner image is not being transferred, and to thereby rotate the external power feed roller 35 when a toner image is not being transferred.

Figure 7D:
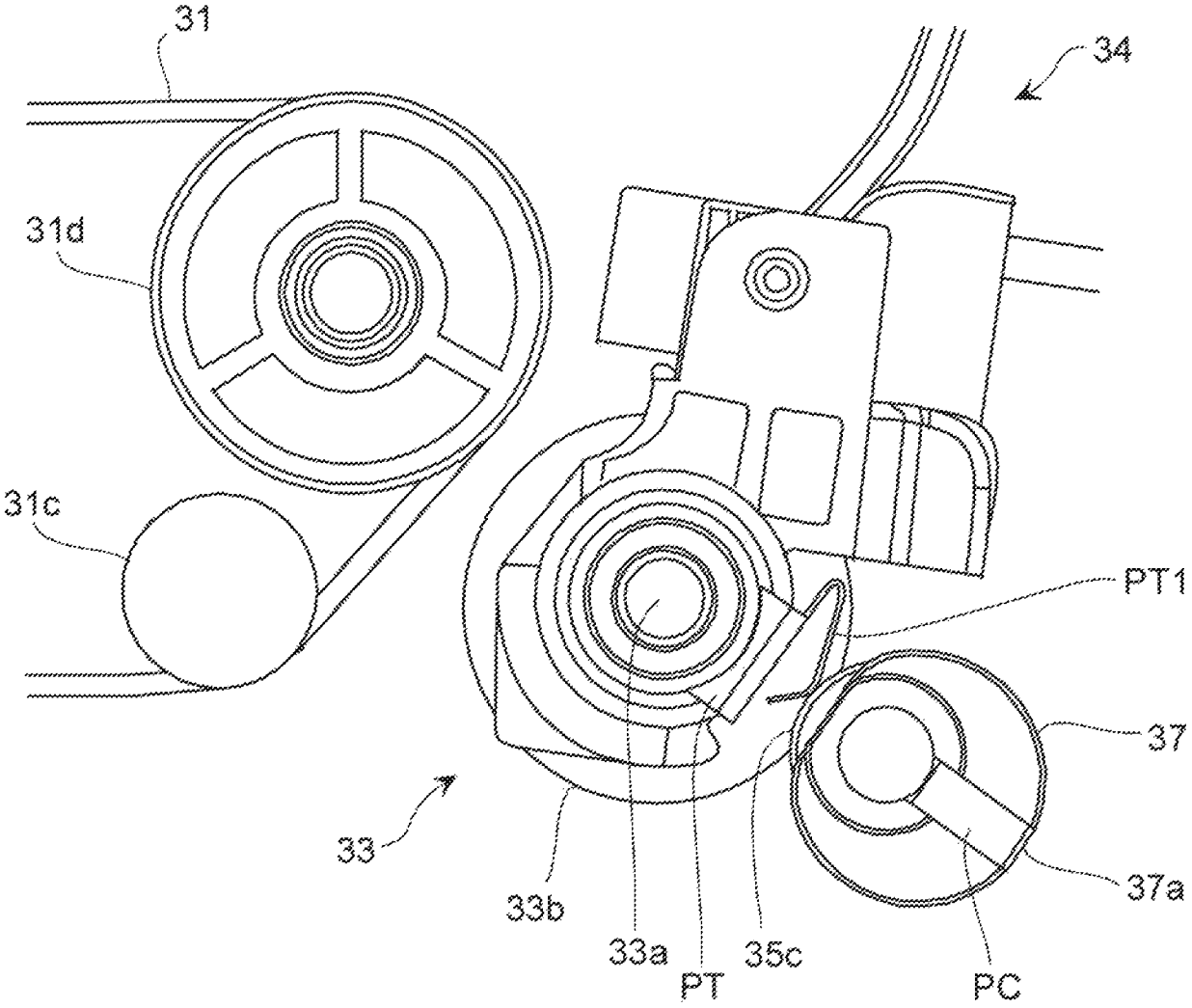
FIG. 7D is a partial left-side view of the example transfer device of FIG. 4, illustrating the operational mode in which no image is being transferred.

FIG. 7D is a side view illustrating the transfer roller 33 and the external power feed roller 35 shown in FIGS. 7A to 7C, as well as the intermediate transfer belt 31 and the drive roller 31*d*. As described above, at the time when a toner image is not being transferred, the cam 37 does not have a cam action (e.g., the cam 37 does not exert force) on the leaf spring PT1 of the transfer roller power feed plate PT, which causes the transfer unit 34 to be urged and rotated by the transfer roller urging mechanism. Consequently, the transfer roller 33 is separated or distanced from the intermediate transfer belt 31 and the drive roller 31*d*, and brought into contact with the external power feed roller 35 to follow in rotation with the external power feed roller 35.

Figure 7E:
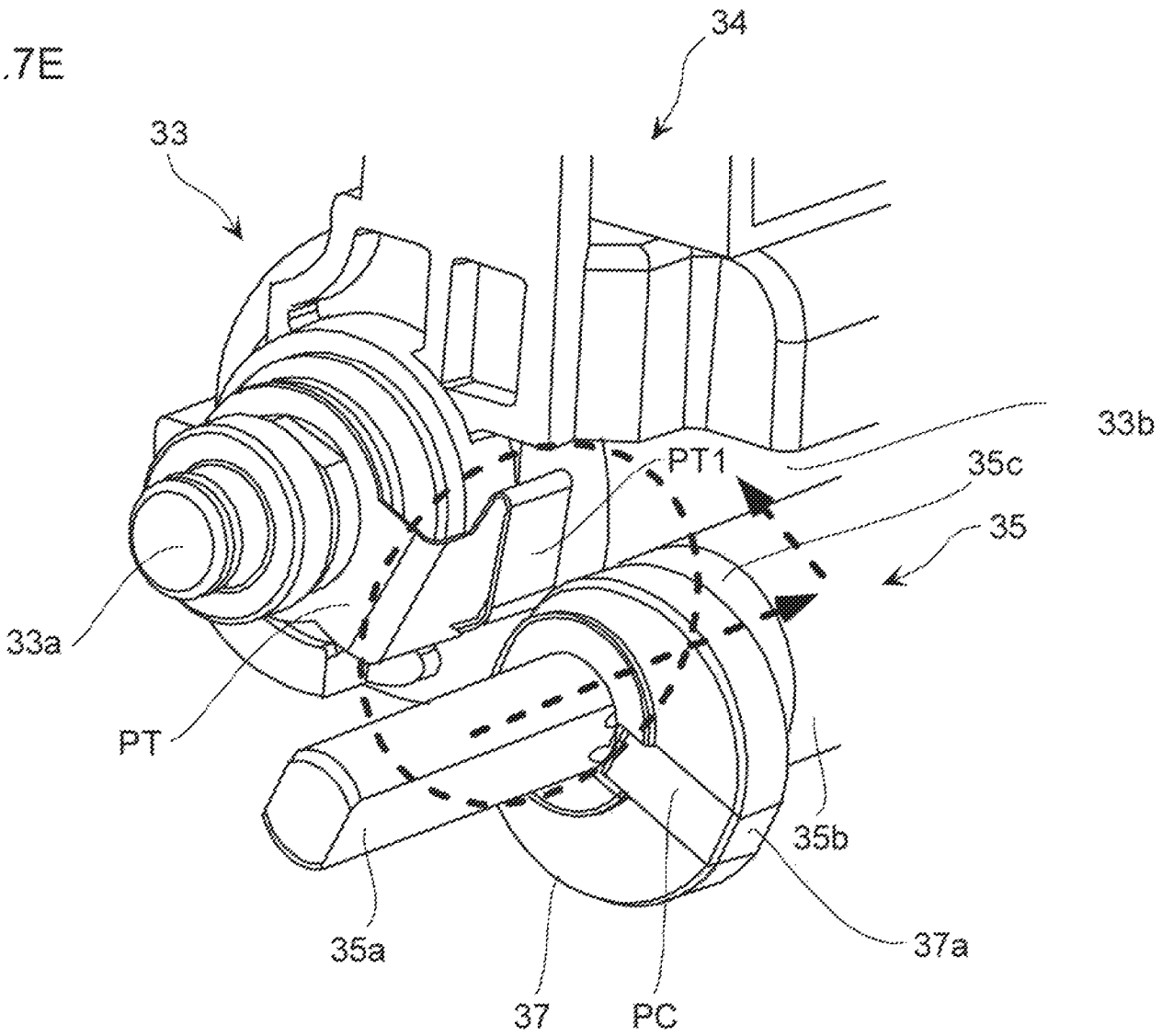
FIG. 7E is a perspective view of the transfer device of FIG. 7A, showing a part of a power-feed path in the example transfer device in the operational mode in which no image is being transferred.

With reference to FIG. 7E showing a similar arrangement to FIG. 7A, a power-feed path (or power supply path) from the power source 70 when a toner image is not being transferred, is indicated by two arrows. A region circled in a broken line indicates that the transfer roller power feed plate PT is electrically disconnected from the cam power feed plate PC on the cam 37. The power-feed path from the power source 70 to the transfer roller 33 in this state is set to supply power via the following sequence of components: Power source 70; Power feed plate PS (cf, FIG. 3); Rotation shaft 35*a*; Conductive member 35*b*; and Ion conductive member 33*b*.

Figure 7F:
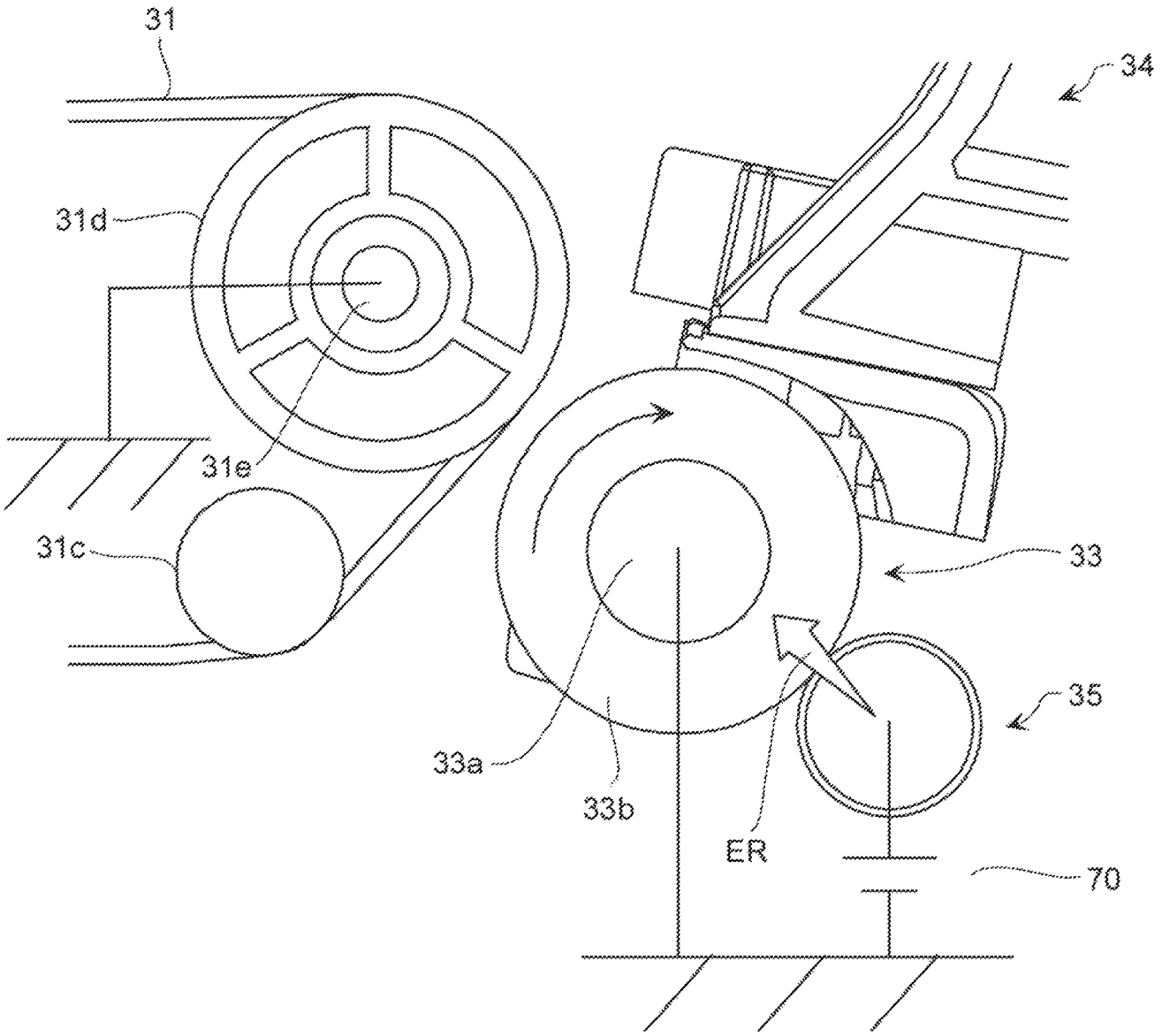
FIG. 7F is schematic side view of the transfer device of FIG. 7D, showing the power-feed path of the example transfer device in the operational mode in which no an image is being transferred.

FIG. 7F is an schematic view illustrating the overall power-feed path. The transfer voltage is fed or supplied from the power source 70 through the conductive member 35*b* (cf. FIG. 7E) of the external power feed roller 35 to the ion conductive member 33*b* of the transfer roller 33, then flows through the ion conductive member 33*b* and the rotation shaft 33*a* electrically connected thereto, and thereafter, to the ground.

Accordingly, an electric field applied to the ion conductive member 33*b* by the transfer voltage from the power source 70 when a toner image is not being transferred has a direction from the surface of the transfer roller 33 to a radially inward direction thereof. This direction of electric field is shown by an arrow ER.

As described above, the example transfer device 30 may apply an electric field to the ion conductive member 33*b* of the transfer roller 33. The electric field is directed in a radially outward direction from the rotation shaft 33*a* of the transfer roller 33 (cf. FIG. 6F) when a toner image is being transferred, and directed in a radially inward direction from the surface of the transfer roller 33 (cf. FIG. 7F) when a toner image is not being transferred. For example, the direction of the electric field applied to the ion conductive member 33*b* in the first operational mode when a toner image is being transferred is reversed, relative to the direction in the second operational mode when a toner image is not being transferred. Consequently in the second operational mode, ions present in the ion conductive member 33*b* when a toner image is not being transferred, move in a reverse direction from the ion movement direction in the first operational mode when a toner image is being transferred, so as to eliminate or reduce an ion imbalance (or polarization), further preventing or inhibiting an increase of volume resistivity of the ion conductive member 33*b*.

The transfer device according to some examples, may use the power source 70 for applying a transfer voltage to the transfer roller 33 and may also use the power source 70 as a power source to eliminate or prevent the polarization of the transfer roller 33. Accordingly, it is not necessary to additionally provide a power source to eliminate or prevent or inhibit polarization, thereby reducing production cost and the like. The transfer device, according to examples, uses a mechanical component for switching a power-feed path of a transfer voltage from the power source as described above. Accordingly, an increase of volume resistivity of the transfer roller using an ion conductive member may be prevented or inhibited without a complicated control mechanism. In addition, the mechanical switch may prevent or inhibit an uneven image transfer or damage on the image carrier that may otherwise be caused by the increase of volume resistivity, thereby improving the durability of the transfer roller, and improving a stability of transfer performance over a prolonged period of usage.

It is to be understood that not all aspects, advantages and features described herein may necessarily be achieved by, or included in, any one particular example, Indeed, having described and illustrated various examples herein, it should be apparent that other examples may be modified in arrangement and detail is omitted.

For example, although an intermediate transfer belt has been described as an image carrier, in some examples, the image carrier may include an intermediate transfer drum. In addition, although a color printer has been described, examples described herein may be applied to a monochrome printer in some examples. In addition, the cam may have any suitable design or shape to provide a stop position that enables a transfer roller to be positioned at a position of no contact with an image carrier or an external power feed roller. For example, in the case of power shutoff of the imaging apparatus installed with the transfer device, the transfer roller can be positioned at a position of no contact with an image carrier or an external power feed roller, to minimize a deformation of the transfer roller and extend a service life thereof. In addition, the transfer roller can be separated or distanced from the external power feed roller after a predetermined period of time sufficient to eliminate polarization of the ion conductive member of the transfer roller since the transfer roller is made to contact with the external power feed roller. This minimizes a period of time for the transfer roller to contact the external power feed roller even when an image is not being transferred, to further extend its service life while minimizing a deformation of the transfer roller.

The invention claimed is:

1. A transfer device for an imaging apparatus, comprising:

a transfer roller to transfer an image formed on an image carrier to a transfer medium in the imaging apparatus, the transfer roller including a rotation shaft comprising a conductive material and an ion conductive member disposed around the rotation shaft;

a power source to generate a transfer voltage; and a switch device to selectively connect, during a rotation of the transfer roller, a power-supply path from the power source to the transfer roller among a plurality of power-supply paths based on whether or not the image is being transferred from the image carrier, to reverse the direction of an electric field applied by the transfer voltage to the ion conductive member.

2. The transfer device according to claim 1, wherein:

the transfer roller is movable to contact the image carrier and to be spaced apart from the image carrier; and the switch device to select the power-supply path:

by moving the transfer roller to contact the image carrier in order to set the power-supply path to extend from the power source, via the rotation shaft of the transfer roller, via the ion conductive member of the transfer roller, via the image carrier and to an electric ground, when the image is being transferred, and by moving the transfer roller away from the image carrier n order to set the power-supply path to extend from the power source, via the ion conductive member of the transfer roller, via the rotation shaft of the transfer roller, and to the electric ground, when the image is not being transferred.

3. The transfer device according to claim 1, wherein the rotation shaft of the transfer roller is a first rotation shaft, and wherein the switch device comprises:

an external power supply roller including a second rotation shaft comprising a conductive material, and a conductive member disposed around the second rotation shaft, the second rotation shaft and the conductive member being electrically connected to the power source to apply the transfer voltage;

an external-power-supply-roller driving device to rotate the external power supply roller when the image is not being transferred;

a biasing device to move the transfer roller to contact the image carrier and be spaced apart from the external power supply roller when the image is being transferred, and to contact the external power supply roller and be spaced apart from the image carrier when the image is not being transferred;

a power supply device to electrically connect the first rotation shaft of the transfer roller and the second rotation shaft of the external power supply roller when the image is being transferred; and a grounding device to electrically ground the first rotation shaft of the transfer roller when the image is not being transferred.

4. The transfer device according to claim 3, wherein the conductive member of the external power supply roller is disposed around the second rotation shaft of the external power supply roller in a rotatable manner relative to the second rotation shaft, wherein the biasing device includes an urging device to urge the transfer roller against the external power supply roller, a cam fixed to an end of the second rotation shaft of the external power supply roller, and a cam driving device to rotate the cam, wherein the power supply device includes a first power supply plate comprising a conductive material, the first power supply plate being disposed on the cam to extend from the second rotation shaft of the external power supply roller to a cam lobe end of the cam, and a second power supply plate comprising a conductive material, the second power supply plate being disposed adjacent to the cam on the first rotation shaft of the transfer roller, wherein the grounding device includes an electrically grounded ground plate comprising a conductive material, the grounding device to be spaced apart from the first rotation shaft of the transfer roller when the image is being transferred, and to contact the first rotation shaft of the transfer roller when the image is not being transferred, and wherein when the image is being transferred, the cam is positioned to push the second power supply plate with the cam lobe end of the cam, such that the transfer roller is spaced apart from the external power supply roller to contact the image carrier and the first power supply plate positioned at the cam lobe end of the cam is electrically connected to the second power supply plate, and when the image is not being transferred, the cam lobe end of the cam is positioned away from the second power supply plate, such that the transfer roller urged by the urging device is spaced apart from the image carrier and in contact with the external power supply roller.

5. The transfer device according to claim 4, wherein the second rotation shaft of the external power supply roller includes a flange comprising a conductive material, the flange being disposed at an end of the conductive member of the external power supply roller in a rotatable manner relative to the second rotation shaft, and wherein the second rotation shaft is electrically connected with the conductive member via the flange.

6. The transfer device according to claim 4, wherein the cam driving device includes a second motor and a second power transmission device to transfer the rotation of the second motor to the cam.

7. The transfer device according to claim 4, wherein the second power supply plate of the power supply device includes a leaf spring to abut against the cam lobe end of the cam when the image is being transferred.

8. The transfer device according to claim 3, wherein the external-power-supply-roller driving device to rotate the external power supply roller, includes a first motor, and a first power transmission device to transfer the rotation of the first motor to the external power supply roller.

9. The transfer device according to claim 3, wherein the conductive member of the external power supply roller includes a metal roller.

10. The transfer device according to claim 3, the biasing device to space apart the transfer roller from the external power supply roller after a predetermined period of time from the transfer roller making contact with the external power supply roller.

11. The transfer device according to claim 3, the biasing device to space apart the transfer roller from the external power supply roller upon power shutoff of the imaging apparatus provided with the transfer device.

12. The transfer device according to claim 3, the biasing device to displace the transfer roller to a position where the transfer roller does not contact the image carrier and does not contact the external power supply roller.

13. An imaging apparatus, comprising:

an image carrier to convey a toner image;

a transfer roller including a conductive rotation shaft and an ion conductive member disposed around the conductive rotation shaft, the transfer roller to operate in a first operational mode in which the transfer roller transfers the toner image from the image carrier to a medium, and in a second operational mode in which the transfer roller does not transfer any toner image from the image carrier;

a power source to generate a transfer voltage; and a switch device to selectively connect, during a rotation of the transfer roller, a power supply path from the power source to the transfer roller among a plurality of power-supply paths based on whether the transfer oiler is operating in the first operational mode or in the second operational mode, in order to select a direction of an electric field applied by the transfer voltage to the ion conductive member.

14. The imaging apparatus according to claim 13, wherein:

the transfer roller is movable to contact the image carrier and to be spaced apart from the image carrier; and the switch device to:

move the transfer roller to contact the image carrier when the transfer roller operates in the first operational mode, and move the transfer roller to be spaced apart from the image carrier when the transfer roller operates in the second operational mode.

15. The imaging apparatus according to claim 13, wherein the rotation shaft of the transfer roller is a first rotation shaft, and wherein the switch device comprises:

an external power supply roller including a second rotation shaft that is conductive, and a conductive member disposed around the second rotation shaft, the second rotation shaft and the conductive member being electrically connected to the power source to apply the transfer voltage;

a driving device to move the external power supply roller in the second operational mode; when no image is being transferred;

a biasing device to move the transfer roller to contact the image carrier and to be spaced apart from the external power supply roller when the transfer roller operates in the first operational mode, and to contact the external power supply roller and be spaced apart from the image carrier when the transfer roller operates in the second operational mode;

a power supply device to electrically connect the first rotation shaft of the transfer roller and the second rotation shaft of the external power supply roller in the first operational mode; and a grounding device to electrically ground the first rotation shaft of the transfer roller in the second operational mode.

* * * * *